United States Patent [19]

Gill et al.

[11] 4,170,214

[45] Oct. 9, 1979

[54] HYDRAULIC VALVE MODULE

[75] Inventors: Arthur W. Gill, Saline; Ronald L. Loup, Clarkston, both of Mich.

[73] Assignee: Double A Products Company, Manchester, Mich.

[21] Appl. No.: 871,219

[22] Filed: Jan. 23, 1978

[51] Int. Cl.[2] ..... F17D 1/00

[52] U.S. Cl. ..... 137/269; 137/884; 137/596

[58] Field of Search ..... 137/884, 269, 271, 596, 137/596.12

[56] References Cited

U.S. PATENT DOCUMENTS

| | | | |
|---|---|---|---|
| 3,654,960 | 4/1972 | Kierman | 137/884 |
| 3,766,943 | 10/1973 | Murata | 137/884 |

*Primary Examiner*—Alan Cohan

*Attorney, Agent, or Firm*—Olsen and Stephenson

[57] ABSTRACT

Apparatus for assembling a complete modular valve system, including modules containing manifold blocks in which are mounted valves, such as flow controls, checks, pressure reducers and reliefs, the modules being sandwich mounted between a directional valve and a standard subplate for use in conjunction with hydraulic cylinders and the like, and the valves being arranged in the manifold blocks so that multiple-function modules can be provided.

11 Claims, 6 Drawing Figures

HYDRAULIC VALVE MODULE

BACKGROUND OF THE INVENTION

The present invention relates to hydraulic valve apparatus for providing a modular valve system between a directional valve and a standard subplate for controlling operation of conventional hydraulic devices, such as hydraulic cylinders and the like.

It is now conventional practice to provide directional valves and subplates which have standard arrangements of ports for directing flow of hydraulic fluid from and to pump and tank and between opposite ends of hydraulic cylinders. It is also known to provide a valve module which includes a manifold block that is sandwich-mounted between the directional valve and the subplate with ports and associated through passageways corresponding to the standard port arrangement, and in which a valve is mounted to perform a function on the hydraulic fluid flowing in a through passageway between associated ports of the directional valve and the subplate. In the known valve modules the valves are mounted on one of the sides of the manifold block and extend inward to a location wherein one or more transverse passageways as well as necessary pilot passageways can be located to provide required communication with the main or through passageways of the manifold block and to provide pilot control of the valve. In the prior art modules, it is the general rule that only one function can be performed by the module because the arrangements required for the transverse and pilot passageways for each included valve are sufficiently complex so as to preclude use of more than one type of flow-function valve within the boundaries of a manifold block. Thus, when a plurality of functions are to be performed within a valve system, a corresponding number of valve modules must be mounted together, thereby multiplying cost and space requirements accordingly.

SUMMARY OF THE INVENTION

The present invention provides an improved valve module that has overcome the inadequacies of the prior art units so that savings in cost and space of the modular valve system can be realized and so that the problems of the designer in developing a suitable system for his needs are minimized.

According to one form of the present invention, a hydraulic valve module is provided which is adapted to be sandwiched between a conventional directional valve and a subplate, each of which has a mounting surface with standardized hole patterns for pressure, tank, and two cylinder ports. The module comprises a manifold block having opposite surfaces adapted to fit respectively against the mounting surfaces of the directional valve and the subplate, the block having ports providing the same standardized hole patterns on the opposite surfaces for alignment with the hole patterns of the directional valve and subplate and having through or main passageways associated respectively with the corresponding ports on opposite surfaces for flow of hydraulic fluid therebetween. The block also has at least one chamber opening to one of the opposite surfaces for receiving a flow-function valve cartridge. The chamber is in communication with one of the sets of corresponding ports so that the one main passageway associated with that set passes through the chamber. A flow-function valve cartridge is mounted in the chamber and has at least one movable element to enable the cartridge to perform a selected function on hydraulic fluid in the associated passageway. The manifold block also has an auxiliary passageway between the chamber and another of the main passageways for pilot actuation of the flow-function valve cartridge.

The flow-function valve cartridge can be any of a variety of pilot operated valves, such as a pilot controlled relief valve, a pilot controlled counterbalance valve, a pilot controlled sequence valve, a pilot controlled reducing valve, a pilot controlled check valve, or the like. For detailed descriptions of various types of flow-function valve cartridges that can be used in connection with the above-identified application, reference is made to U.S. Pat. No. 3,613,715, patented Oct. 19, 1971, in the name of Charles E. Johnson.

By virtue of the construction and arrangement wherein the chamber for the flow-function valve cartridge opens to one of the opposite surfaces of the block a much simplified arrangement can be adopted for placing the chamber in communication with the desired main passageway or passageways, and the flow-function valve cartridge can be housed within a space within the block which otherwise would not be used. This readily permits more than one such chamber and flow-function valve cartridge to be incorporated within a single manifold block. A control-function valve cartridge can then readily be mounted externally on one of the side walls of the block for adjustable pilot control of the internally mounted flow-function valve cartridge by means of relatively small auxiliary or pilot passageways which can much more readily be introduced into the block than is the case when transverse passageways are introduced into the block to accommodate the needs of a flow-function valve cartridge that may be mounted externally of the block or that may be introduced into the side of the block as is done in certain of the prior art units.

The unique construction and arrangement wherein the flow-function valve cartridge is separated from the control-function valve cartridge for any given valve assembly, and the separate flow-function valve cartridge is then housed within a chamber that opens to one of the opposite mounting surfaces of the block provides a substantial improvement in the arrangement required to permit communication between the flow-function valve cartridge and the appropriate associated main passageway. A saving of space and simplification of arrangement of passageways can be achieved to an extent sufficient to permit multiple-function modules to be manufacured and used, as distinguished from the single-function modules found in the prior art. These improved features not only reduce the costs and conserve space for a modular valve system, but substantially simplify the problem of the designer when ordering components for the complete valve system that he is designing.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENTS

Figure 1:
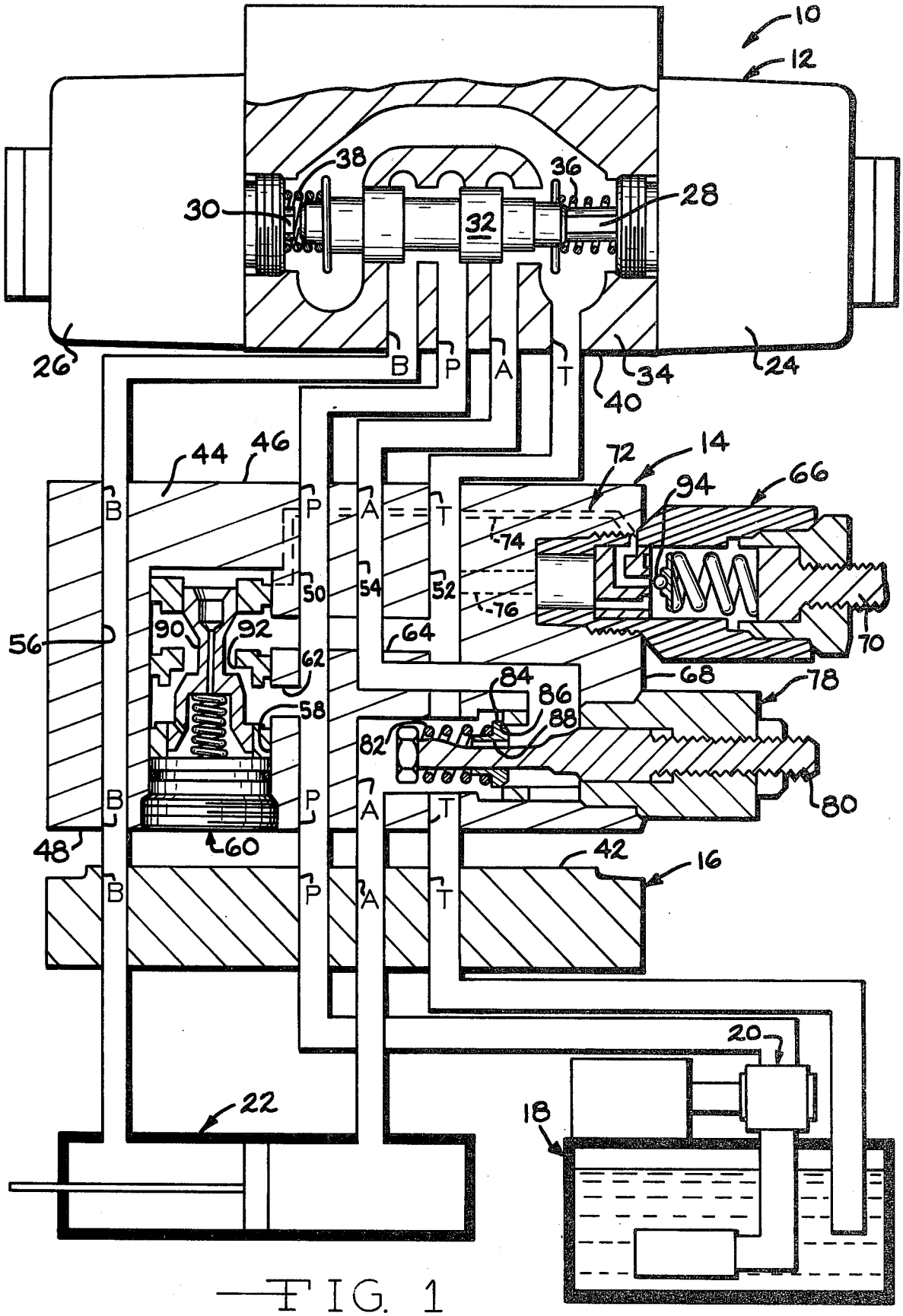
FIG. 1 is a schematic view of a hydraulic system in which a hydraulic valve module embodying the present invention is shown in vertical section between a directional valve and a subplate.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The hydraulic system 10 shown schematically in FIG. 1, includes a directional valve 12, a hydraulic valve module 14 embodying the present invention, a subplate 16, a tank 18 containing hydraulic fluid, a pump 20 for pumping hydraulic fluid under pressure from the tank 18 to the directional valve 12, and a hydraulic cylinder 22 adapted to be actuated by hydraulic fluid flowing through the directional valve 12.

The directional valve 12 is conventional apparatus that has solenoids 24 and 26 at opposite ends for moving the push pins 28 and 30 for positioning the spool 32 at selected positions within the valve body 34. Springs 36 and 38 are positioned at opposite ends of the spool 32 to assist in locating the latter. The valve body 34 has a mounting surface 40 which contains ports through which hydraulic fluid can flow in accordance with the setting of the spool 32. The port which is in communication with the discharge side of the pump 20 is the pressure port P, the port which is in communication with the tank through which hydraulic fluid can be discharged from the directional valve 12 to tank is the tank port T, the port which is adapted to be connected to one end of the hydraulic cylinder 22 is the cylinder port A, and the port which is adapted to be connected to the other end of the hydraulic cylinder 22 is the cylinder port B. The hole pattern of these ports have been standardized by industry, as will presently be described.

The subplate 16 has a mounting surface 42 which also has a group of ports P, T, A and B, these latter ports having the same standardized hole pattern as the corresponding ports in the directional valve 12 so that if the subplate were mounted against the directional valve 12, the ports would be in registry.

Sandwich-mounted between the directional valve 12 and the subplate 16 is the hydraulic valve module 14. The latter includes the manifold block 44 which has parallel flat opposite surfaces 46 and 48 which again contain ports P, T, A, and B which are arranged to have the same hole pattern as the corresponding ports in the directional valve 12 and the subplate 16 so that when the manifold block 44 is sandwich-mounted, the ports of the manifold block 44 will be in registry with the corresponding ports of the directional valve 12 and subplate 16. The standardized hole pattern can be seen in FIGS. 2 and 3.

In the manifold block 44, a main or through passageway 50 extends between the pressure ports P, a main or through passageway 52 extends between the tank ports T, a main or through passageway 54 extends between the cylinder ports A, and a main or through passageway 56 extends between the cylinder ports B. Also formed in the manifold block 44 is the chamber 58 which opens to the surface 48 for receiving the flow-function valve cartridge 60. The chamber 58 is in communication with the main passageway 50 to pump 20 by the transverse passageway 62 and is in communication with the main passageway 52 to tank 18 by the transverse passageway 64. The flow-function valve cartridge 60, which is one portion of a pilot controlled relief valve, will control flow of hydraulic fluid from the pump 20 to the end of the hydraulic cylinder 22 that is in communication with port B. The other portion of the pilot controlled relief valve is the control-function valve cartridge 66 which is mounted on one side wall 68 of the manifold block 44 and includes adjustment means 70 operably associated with the auxiliary passageway 72 for controlling the pilot actuation of the flow-function valve cartridge 60. The auxiliary passageway 72 includes the pilot duct 74 extending from the flow-function valve cartridge 60 to the control-function valve cartridge 66 and the discharge duct 76 extending from the control-function valve cartridge 66 to the tank port passageway 52.

From the foregoing description it will be apparent that the pilot control relief valve has been separated into a flow-function valve cartridge 60, which regulates a function of the fluid flowing in the passageway 50, and a control-function valve cartridge 66 which pilot actuates the cartridge 60. By separating the relief valve into two assemblies in this manner, the flow-function valve cartridge can be housed in the manifold block 44 in a location not otherwise used and adjacent to the main passageways 50 and 52 with which the flow-function valve cartridge 60 must communicate. This latter feature significantly simplifies the transverse passageways that must be introduced into the manifold block 44. The control-function valve cartridge 66 can be mounted on the side wall 68 and pilot ducts 74 and 76 must be introduced into the manifold block 44, but because the pilot passageways can be relatively small, they do not create significant problems with respect to introducing them into the manifold block 44.

Also mounted on one side wall of and extending into the manifold block 44 is the conventional flow-control valve cartridge 78, which functions to meter out hydraulic fluid that is discharged from one end of hydraulic cylinder 22 via ports A to the tank via ports T, and which can open to allow rapid flow of hydraulic fluid in the reverse direction. The selected flow rate in the metering out direction can be established by manual turning of the adjustment means 80 for selectively setting the axial position of the stem (adjustment means 80) with respect to the check element 84 on its seat 86. Metering out of the hydraulic fluid occurs through the metering duct 88. In the illustrated embodiment, the flow-control valve cartridge 78 is located in the main passageway 52 between ports A and it is mounted in the manifold block 44 in the conventional manner of the prior art. However, by virtue of the improved features relative to the cartridge 60, a double-function module 14 is provided.

With respect to the flow-function and fluid-control valve cartridges 60 and 66 that comprises the pressure relief valve in the illustrated embodiment, the flow-function valve cartridge 60 is mounted in association with the main passageway 50 between ports P to provide pressure relief in the fluid circuit from pump 20 to hydraulic cylinder 22 via ports B. This is accomplished by movable valve element 90, in the flow-function valve cartridge 60, opening the necessary amount at valve port 92 to allow discharge of a portion of the pressurized fluid from pump 20 to the transverse passageway 64 to tank 18, thereby controlling pressure of the fluid to the hydraulic cylinder 22 via ports B. The opening of port 92 is determined by the setting of the adjustment means 70 which determines when the spring actuated ball 94 will be unseated by pressure of hydraulic fluid in pilot duct 74 so as to allow fluid to flow to tank via ducts 74 and 76 from the chamber 58 above movable valve element 90. For more detailed description of the components of valve cartridges 60 and 66, reference is made to the aforesaid U.S. Pat. No. 3,613,715. Reference is also made to this patent for detailed descriptions of a variety of other valve constructions that can be used in cartridge form to provide other embodiments of the present invention, such as the valve cartridge arrangements described hereinafter and illustrated in FIG. 6.

Figure 2:
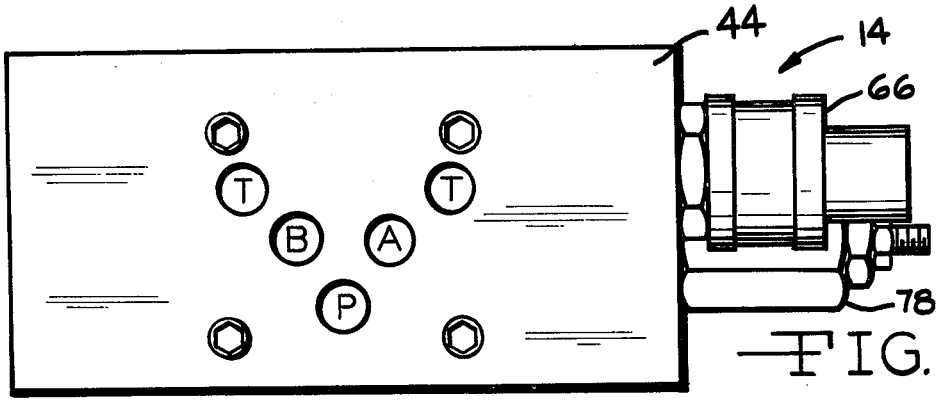
FIG. 2 is a top plan view of the hydraulic valve module illustrated in FIG. 1.
Figure 3:
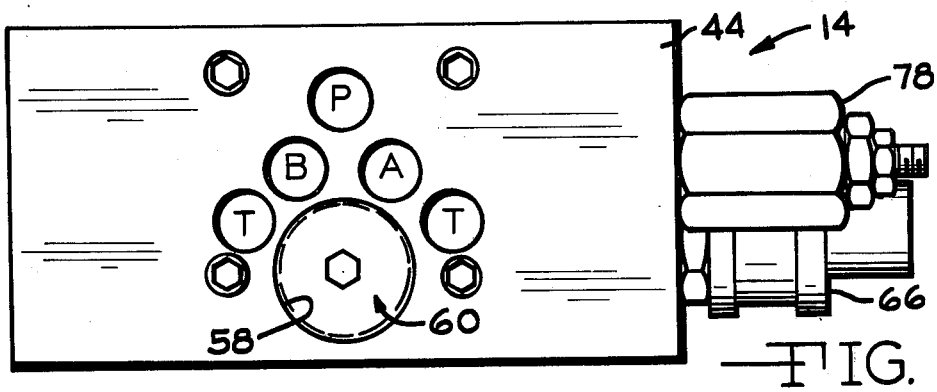
FIG. 3 is a bottom plan view of the hydraulic valve module of FIG. 1, showing one flow-function valve cartridge mounted in the manifold block.
Figure 4:
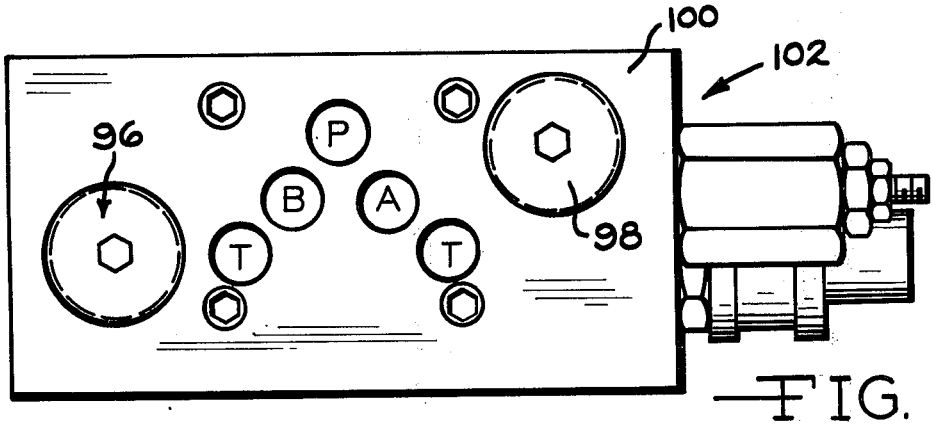
FIG. 4 is a bottom plan view of another hydraulic valve module, showing two flow-function valve cartridges mounted in the manifold block.
Figure 5:
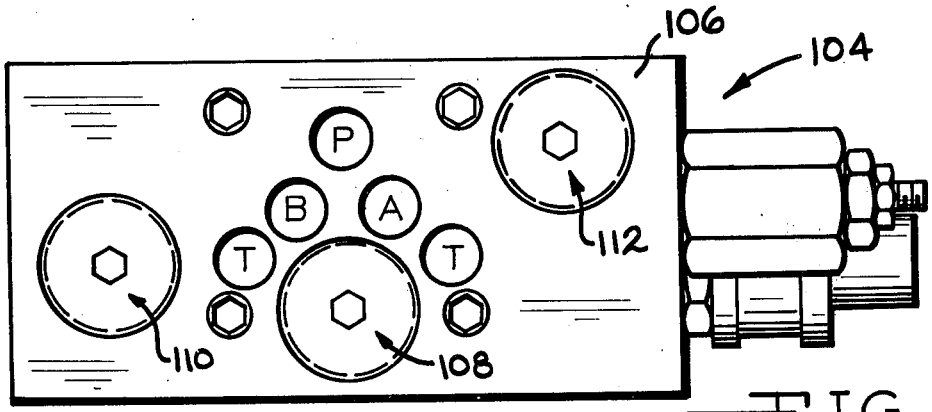
FIG. 5 is a bottom plan view of still another hydraulic valve module, showing three flow-function valve cartridges mounted within the manifold block.

Referring to FIG. 4, it can be seen that a flow-function valve cartridge can be located at other locations than that of cartridge 60 in the embodiment of FIGS. 1-3. As shown, flow-function valve cartridges 96 and 98 are mounted in the manifold block 100 at other locations to provide a multiple-function module 102. Similarly, as shown in FIG. 5, still a third flow-function valve cartridge can be added to provide a multiple-function module 104 which has a manifold block 106 and flow-function valve cartridges 108, 110 and 112. In all of these arrangements, the axis of the valve cartridge is parallel to the main passageways to facilitate boring of transverse passageways from the chambers that house the cartridges to the main passageways.

Referring now to the schematic illustration of FIG. 6, a variety of double-function modules embodying the present invention will be described briefly. Double-function module 114 is a module wherein a relief valve cartridge is operatively positioned between main passageway 50 from pump 20 and main passageway 52 to tank 18, in the same manner as is illustrated in the embodiment in FIG. 1, and in addition, a sequence valve cartridge is operatively positioned in main passageway 54 between the A ports which are in communication with one end of hydraulic cylinder 62. Valve module 116 is similar to valve module 114 but in this embodiment, the sequence valve cartridge is mounted in association with the main passageway 56 that extends between ports B that are in communication with the other end of the hydraulic cylinder 22. As can be seen in the drawing, in both of the embodiments of modules 114 and 116, the sequence valve cartridge is pilot actuated, the sequence valve of module 114 having pilot ducts 118 and 120 and the module 116 having pilot ducts 122 and 124. In both of these sequence valves, the control-function valve cartridge will be mounted on a side wall of the valve module and the flow-function portion of the valve will be housed within a chamber of the manifold block similar to the mounting of cartridge 60 in the embodiment of FIG. 1.

The double-function modules 126, 14, 128, 130, 132 and 134 show a plurality of arrangements wherein relief and flow-control valve functions are provided. It will be noted that the embodiment of the invention shown in FIG. 1 is illustrated schematically at 14 in FIG. 6. The double-function valve module 126 is identically the same as the valve module 14, except that the former also has a flow-control valve arrangement to meter out the fluid from the other end of the hydraulic cylinder 22 which is in communication with ports B. Similarly, double-function module 128 is the same as double-function module 14, except that the flow-control valve is located only in association with main conduit 56.

Double-function modules 130, 132 and 134 are the same as double-function modules 126, 14, and 128, except that the former are flow-control valves that "meter into" the hydraulic cylinder 56 rather than "meter out" of the hydraulic cylinder 56.

Double-function valve modules 138, 140, and 142 have similar pressure relief valves associated with main passageways 50 and 52 as those that were previously described, and in addition have pilot controlled check valves. The check valves are located in either one or the other of the main passageways 54 and 56 to the hydraulic cylinder 22 or are located in both, as shown, for example, with respect to double-function module 138. These valves are not adjustable and therefore they do not require flow-control valve cartridge for mounting externally on the manifold block of the double-function valve module.

Double-function modules 144, 146, 150, 152 and 154 show a plurality of arrangements of pressure reducing valves and flow-control valves. Similarly, modules 156, 158, and 160 show a plurality of arrangements of pressure reducing valves and check valves. Again, the valves will be formed with flow-function cartridges and control-function cartridges with the former being housed in chambers within the manifold block and the latter mounted on a side wall of the manifold block and extending into the block.

Figure 6:
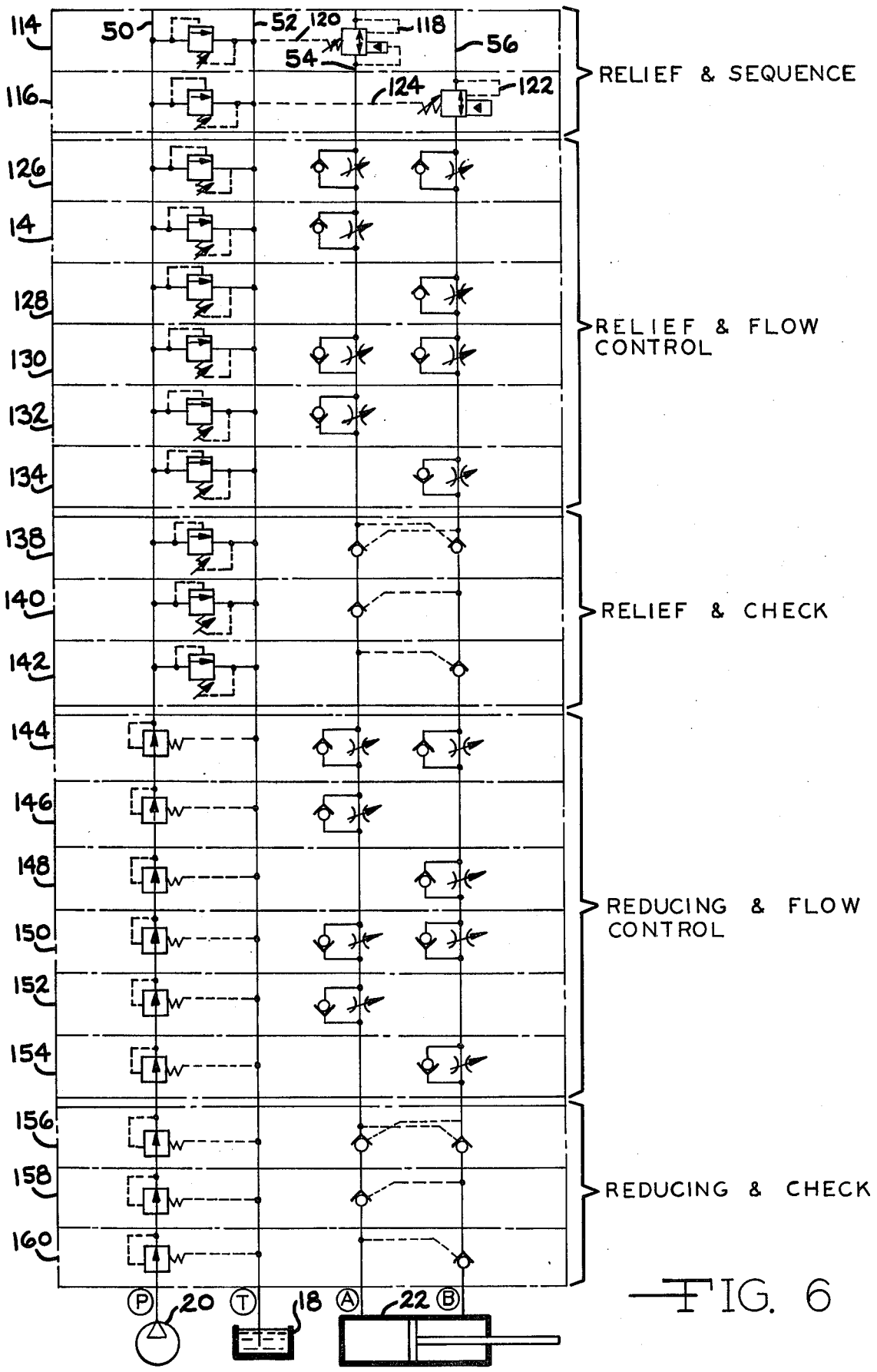
FIG. 6 is a schematic illustration of a large number of double-function valve modules, stacked one above another in association with a pump, tank and hydraulic cylinder, each module embodying the present invention.

With respect to the components of the valves shown schematically in FIG. 6, more detailed descriptions can be found in the aforesaid U.S. Pat. No. 3,613,715, and these components and their operation will not be described in detail here, because full explanations can be found in the aforesaid patent and the individual designs of the cartridges are not a part of this invention.

It is claimed:

1. A hydraulic valve module adapted to be sandwiched between a directional valve and a subplate, each of which has a mounting surface with uniform hole patterns for pressure, tank, and two cylinder ports, said module comprising a manifold block having opposite surfaces adapted to fit respectively against the mounting surfaces of the directional valve and the subplate, said block having ports providing uniform hole patterns on said opposite surfaces for alignment with the hole patterns of said directional valve and subplate and having main passageways associated respectively with the sets of corresponding ports on opposite surfaces for flow of hydraulic fluid therebetween, said block also having at least one chamber opening to one of said opposite surfaces to provide an entrance of a size sufficient for receiving a flow-function valve cartridge, said chamber being in communication with one of said sets of corresponding ports so that the one main passageway associated with that set passes through the chamber, and a flow-function valve cartridge dimensioned for insertion through said entrance and housed within said chamber, said flow-function valve cartridge having at least one movable element to enable the cartridge to perform a selected function on hydraulic fluid in said one associated passageway, said manifold block also having an auxiliary passageway between said chamber and another of said main passageways for pilot actuation of said flow-function valve cartridge.

2. The hydraulic valve module that is defined in claim 1, wherein said flow-function valve cartridge includes one of the valves from the following group:

(a) pilot controlled relief valve,
(b) pilot controlled counterbalance valve,
(c) pilot controlled sequence valve,
(d) pilot controlled reducing valve, and
(e) pilot controlled check valve.

3. The hydraulic valve module that is defined in claim 1, wherein a control-function valve cartridge is mounted on one side wall of the manifold block and includes adjustment means operably associated with said auxiliary passageway for controlling the pilot actuation of said flow-function valve cartridge.

4. The hydraulic valve module that is defined in claim 3, wherein said auxiliary passageway includes a pilot duct extending from said flow-function valve cartridge to said control-function valve cartridge and a discharge duct from said control-function valve cartridge to the tank port passageway.

5. The hydraulic valve module that is defined in claim 4, wherein said flow-function valve cartridge includes one of the valves from the following group:

(a) pilot controlled relief valve,
(b) pilot controlled counterbalance valve,
(c) pilot controlled sequence valve, and
(d) pilot controlled reducing valve.

6. The hydraulic valve module that is defined in claim 1, wherein said manifold block has a second chamber opening to one of said opposite surfaces to provide a second entrance of a size sufficient for receiving another flow-function valve cartridge, said second chamber being in communication with a second one of said sets of corresponding ports so that the main passageway associated with the second set passes through the second chamber, and a second flow-function valve cartridge dimensioned for insertion through said second entrance and housed within said second chamber, said second flow-function valve cartridge having at least one movable element to enable the cartridge to perform a function on hydraulic fluid in the main passageway associated with the second set, said manifold block also having a second auxiliary passageway between said second chamber and another main passageway for pilot actuation of said second flow-function valve cartridge.

7. The hydraulic valve module that is defined in claim 6, wherein a control-function valve cartridge is mounted on a side wall of the manifold block and includes adjustment means operably associated with one of said auxiliary passageways for controlling the pilot actuation of the flow-function valve cartridge associated with that auxiliary passageway.

8. The hydraulic valve module that is defined in claim 7, wherein a second control-function valve cartridge is mounted on a side wall of the manifold block and includes adjustment means operably associated with the other of said auxiliary passageways for controlling the pilot actuation of the flow-function valve cartridge associated with that auxiliary passageway.

9. The hydraulic valve module that is defined in claim 6, wherein said manifold block has a third chamber opening to one of said opposite surfaces to provide a third entrance of a size sufficient for receiving another flow-function valve cartridge, said third chamber being in communication with a third one of said sets of corresponding ports so that the main passageway associated with the third set passes through the third chamber, and a third flow-function valve cartridge dimensioned for insertion through said third entrance and housed within said third chamber, said third flow-function valve cartridge having at least one movable element to enable the cartridge to perform a function on hydraulic fluid in the main passageway, said manifold block also having a third auxiliary passageway between said third chamber and another main passageway for pilot actuation of said third flow-function valve cartridge.

10. The hydraulic valve module that is defined in claim 9, wherein a control-function valve cartridge is mounted on a side wall of the manifold block and includes adjustment means operably associated with said third auxiliary passageway for controlling the pilot actuation of the flow-function valve cartridge associated with said third auxiliary passageway.

11. The hydraulic valve module that is defined in claim 10, wherein a second control-function valve cartridge is mounted on a side wall of the manifold block and includes adjustment means operably associated with said third auxiliary passageway for controlling the pilot actuation of the flow-function valve cartridge associated with said third auxiliary passageway.

* * * * *